United States Patent [19]

Bornhorst

[11] Patent Number: 5,073,847

[45] Date of Patent: Dec. 17, 1991

[54] VARIABLE COLOR LIGHTING INSTRUMENT

[75] Inventor: James M. Bornhorst, DeSoto, Tex.

[73] Assignee: Vari-Lite, Inc., Dallas, Tex.

[21] Appl. No.: 578,594

[22] Filed: Sep. 6, 1990

[51] Int. Cl.[5] ..... F21V 9/12

[52] U.S. Cl. ..... 362/293; 362/281; 362/283; 362/323

[58] Field of Search ..... 362/293, 281, 283, 277, 362/322, 323

[56] References Cited

U.S. PATENT DOCUMENTS

| | | | |
|---|---|---|---|
| 2,913,572 | 11/1959 | Fritzlen | 362/283 |
| 3,080,474 | 3/1963 | Allen | 362/281 |
| 3,426,189 | 2/1969 | Deputy | 362/283 |
| 3,604,922 | 9/1971 | Steel | 362/283 |
| 3,609,339 | 9/1971 | Smith et al. | 362/283 |
| 4,602,321 | 7/1986 | Bornhorst | 362/293 |
| 4,974,136 | 11/1990 | Noorishad et al. | 362/283 |

*Primary Examiner*—Ira S. Lazarus
*Assistant Examiner*—Sue Hagarman
*Attorney, Agent, or Firm*—Morgan & Finnegan

[57] ABSTRACT

A lighting instrument having pivotable dichroic filters arranged in a substantially radial arrangement with respect to a projected light beam. Multiple sets of such filters are spaced along the axis of the light beam to vary the color of the light beam emitted from the instrument. A gearing mechanism rotates all filters of each set in synchronization with each other and independently with respect to filters of the other sets. The filters may be positioned to pass unfiltered light to vary the saturation of the light beam.

20 Claims, 8 Drawing Sheets

VARIABLE COLOR LIGHTING INSTRUMENT

TECHNICAL FIELD OF THE INVENTION

The present invention relates to lighting instruments, and more particularly to a light source having movable filters for varying the color of a light beam.

BACKGROUND OF THE INVENTION

It has long been known to provide spot lights or directed lighting for stages, theaters, and other environments with the use of individual light sources hung from trusses or fixed structural members mounted adjacent to the area to be lit. Some light sources are used as wash or general area lighting, while other light sources are used as spot lights for highlighting specific positions on stage, portions of a performer's body or the like. In other applications, directable light sources are used to illuminate such environments as homes or offices.

Various devices are known in the art for changing the color of the light emitted from a light source. For example, light transmissive colored sheets or "gels" may be interposed in the light beam to change the color of the light. A variety of mechanical means exist for exchanging various differently colored gels in a single lighting instrument. Slide changers have long been used in high-powered spot light applications. Under the control of a human operator, the spot of light projected upon the stage follows the performer as he or she moves. The operator can also manipulate gel frames mounted on tracks such that one filter can slide into a position transverse to the light beam while another filter can slide out of the light beam, thereby changing the color of the beam.

More recent systems have been devised to exchange colored gels by means of a remotely-controlled, motorized mechanism. In one such system known as the scrolling gel changer, up to 16 or more colored gels are connected together by glue or adhesive tape in a side-by-side fashion to form a long strip of colored gels. The strip is then wound onto a supply reel, threaded through the mechanism so as to cover the forward aperture of a lighting instrument, and connected to a take-up reel. With a motor drive provided to rotate either the supply reel or the take-up reel, the gel strip can be wound or unwound so as to position the desired gel over the forward aperture, thereby changing the color of the light beam projected from the lighting instrument.

Other recent systems have been devised in which many parameters of a light beam projected by a lighting instrument can be varied by remote control, including the orientation of the instrument with respect to azimuth and elevation, the diameter of the beam, the shape of the beam, the divergence of the beam, as well as the color and intensity of the beam. U.S. Pat. No. 4,392,187 by Bornhorst typifies such automated systems. Bornhorst '187 discloses computerized remote control of automated lighting instruments having motorized mechanisms for varying the aforementioned parameters of the light beams. Bornhorst '187 achieves color control by means of positionable dichroic filters rather than the gels mentioned above.

Another example of a dichroic-filter color changer is disclosed in U.S. Pat. No. 4,602,321 by Bornhorst, wherein three filter sets each include three pivotable dichroic filter elements. Each filter element is rotatable around an axis perpendicular to the light beam in order to vary the angle of incidence and thereby vary the hue of the light beam. Rotation of the filter elements also varies the white light transmitted past the filter elements to vary the saturation of the light beam.

The present invention is directed to a lighting instrument having an improved color changing mechanism employing pivotable filters. The invention achieves improved beam color variation in a compact, modular assembly. Other improvements and advantages will be apparent from the following description of the invention.

SUMMARY OF THE INVENTION

In accordance with the present invention, a lighting instrument projects a light beam of variable color. At least one set of filters is disposed generally transverse to the axis of the light beam. Each filter of the set is pivotable about an axis intersecting the axis of the light beam. A drive mechanism controls the rotation of each filter to vary the color of the light beam emitted from the instrument.

BRIEF DESCRIPTION OF THE DRAWINGS

A more complete understanding of the present invention may be had by reference to the following Detailed Description read in conjunction with the accompanying drawings, wherein.

DETAILED DESCRIPTION

Figure 1:
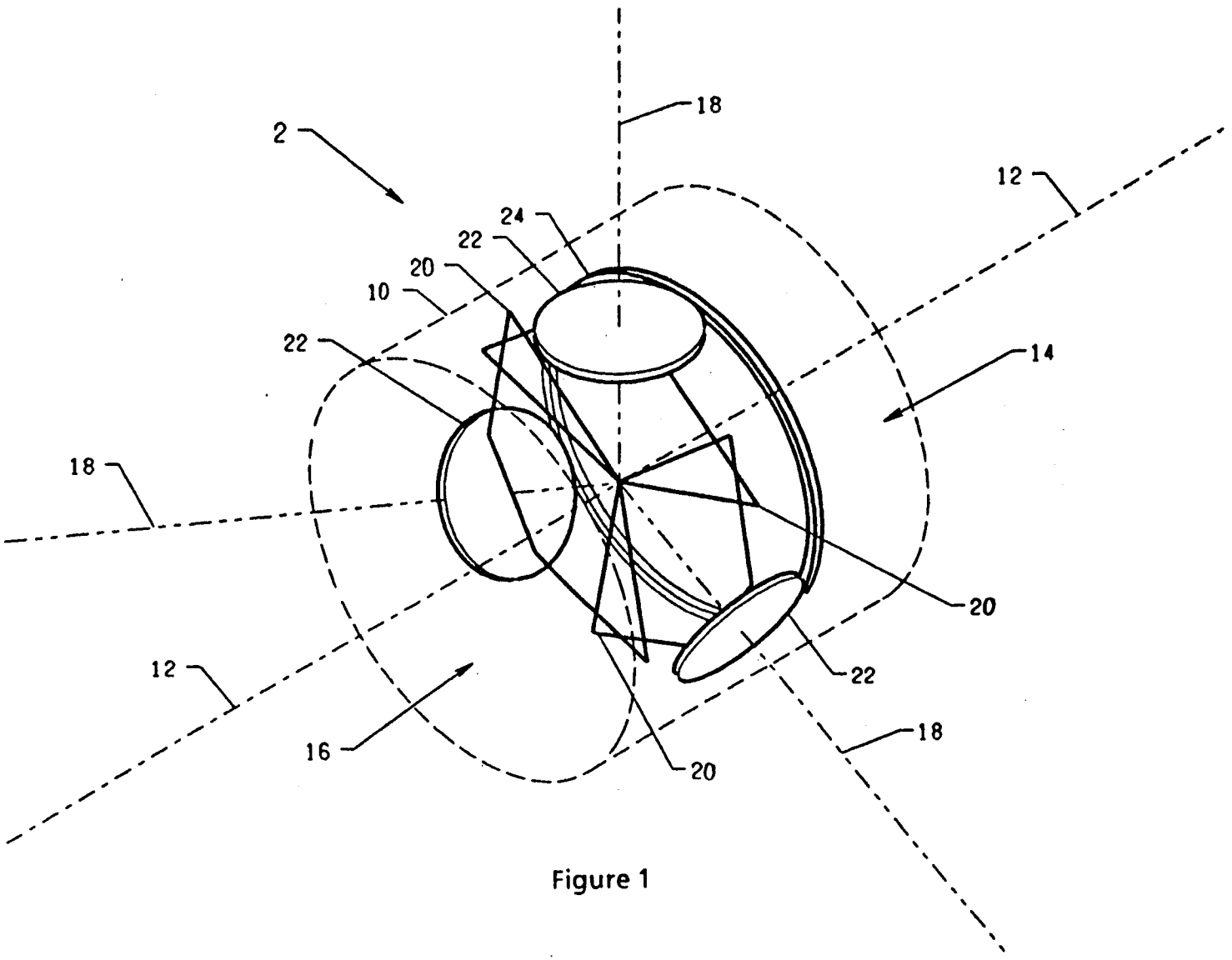
FIG. 1 is a schematic perspective view of a subassembly of pivotable filters in accordance with the present invention.

Referring now to FIG. 1, a pivoting-filter module or subassembly 2 which forms a part of the lighting instrument of the present invention will be described. The subassembly 2 is constructed within a tubular frame 10 (shown in phantom) having a longitudinal or primary axis 12 extending from an input aperture 14 to an output aperture 16. Three filters 20 are supported for rotation about respective axes 18 which preferably intersect the primary axis 12 to provide a radial arrangement when viewed from either end in the direction of the axis 12. The filters 20 comprise dichroic filters having identical optical characteristics and are pivotably supported near the axis 12 in a manner such as that described below with reference FIGS. 5B and 5C. The filters 20 are supported at their outer ends by gear wheels 22 which are interconnected by a suitable drive mechanism, such as ring gear 24, whereby all the wheels rotate simultaneously and at the same angular velocity.

The filters 20 can be pivoted about their axes 18 from a closed position as depicted in FIG. 1 to an open position in which they are substantially parallel to the primary axis 12. It will be appreciated that the filters 20 may be rotated to any intermediate position between the aforementioned positions. The subassembly 2 is further characterized in that all filters therein are presented at the same angle to a light beam which is parallel to the primary axis 12 and passes through the filters.

The subassembly 2 is adapted to receive a white light beam through the input aperture 14, selectively change the color of the light beam as the beam passes through the filters 20, and transmit the colored light beam through the output aperture 16. When the dichroic filters 20 are in the closed position, it will be appreciated that virtually all of the rays of the light beam are intercepted by the filters. When the dichroic filters 20 are rotated to the other extreme position in which they are parallel to the longitudinal axis 12, essentially none of the rays of the light beam are intercepted by the filters. By positioning the filters 20 at selected positions between such extreme positions, the hue and saturation of the resulting light beam can be varied in a controlled manner.

The dynamic color-changing effects achieved by the present invention are determined by the characteristics of dichroic filters. The aforementioned U.S. Pat. No. 4,392,187 discloses changing the angle of incidence of a dichroic filter relative to a light beam to cause the color spectrum transmitted through the filter to be varied. Dichroic filters work on an interference principle, essentially separating two colors out of a white light source, one color being transmitted and the other color, the complement of that being transmitted, being reflected. The color transmitted through the dichroic filter depends upon the types of materials used in the filter layers and their refractive indices, the thickness of each layer, the number of the layers, and the angle of incidence of the white light source striking the surface of the filter. By varying the angle of incidence of the filters, a preselected range of colors may be produced.

The dichroic filters for use with the present invention may comprise numerous commercially available filters made from dielectric film coating on glass or the like. The dichroic film is made of multiple layers in which alternate layers have low and high indexes of refraction, respectively.

Figure 2:
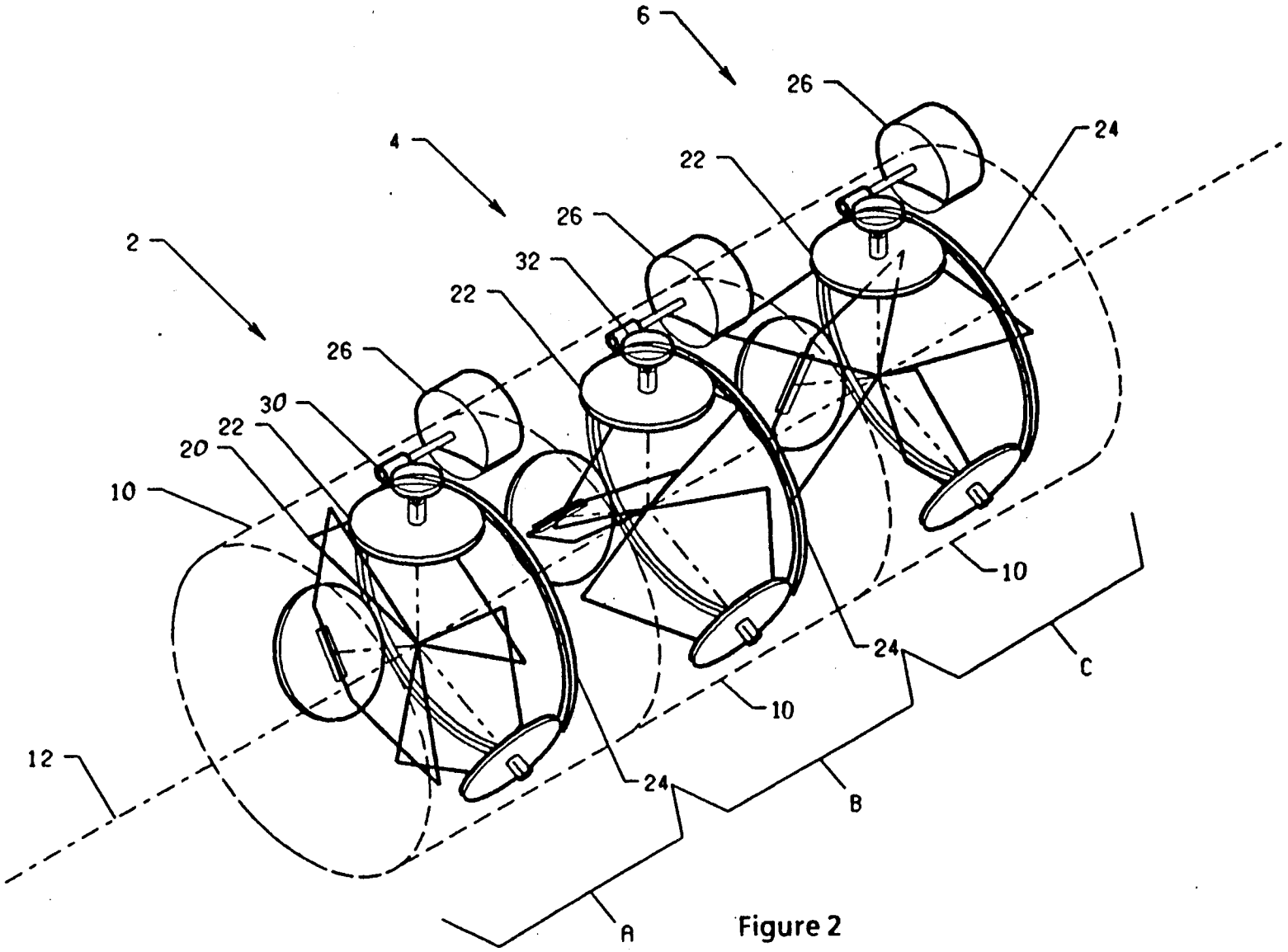
FIG. 2 is a schematic perspective view of three adjoining subassemblies or modules of pivotable filters showing different filter orientations.

Referring now to FIG. 2, three subassemblies or modules 2, 4 and 6 are connected in optical series relationship with their frames 10 (shown in phantom) abutting to form a single tubular arrangement. Each module has a set of three dichroic filters which are pivotable in the manner described above with reference to the filters 20 of FIG. 1.

The sets of filters of FIG. 2 are shown rotated to different positions. Module 2 shows filter set A with its filters in the closed position in which they intercept substantially all of the light rays passing through module 2.

Module 4 shows filter set B with its filters aligned substantially parallel to the longitudinal axis 12. This position will be referred to as the open position in which the filters intercept essentially none of the light rays passing through the module.

Module 6 shows filter set C with its filters disposed in an intermediate position between the open and closed positions. The actual intermediate position shown in FIG. 2 is such that the planes defined by the filters of set C are each disposed at 45-degree angles to the longitudinal axis 12.

In the embodiment shown in FIG. 2, all of the filters of each set have their axes of pivotal movement intersecting the primary axis 12 at a common point. In the preferred embodiment, the axes of pivotal movement of the filters of each set d ®fine a radial plane. The present invention contemplates various alternative configurations in which the filters of each set are staggered in position so that their axes do not intersect the primary axis 12 at a common point. In one such configuration, the axes of pivotal movement of the filters within each set are spaced apart slightly along the primary axis 12 so that the filters, when in the closed position, have the appearance of stairs in a spiral staircase.

In a preferred arrangement, the filters of set A consist of long-wave pass amber filters, the filters of set B consist of short-wave pass blue filters, and the filters of set C consist of complex-color magenta filters. In such an arrangement, the lighting instrument is capable of producing a large selection of beam colors due to the combined effect of the three sets of filters in series.

It will be appreciated that at least some degree of white light is passed through module 6 if the filters therein are positioned in intermediate positions other than a range of positions near the closed position. In like manner white and colored light leaving module 6 may pass partially around the filters of module 4 if they are not in the closed or near the closed position. The same is true of light passing through module 2.

Figure 3:
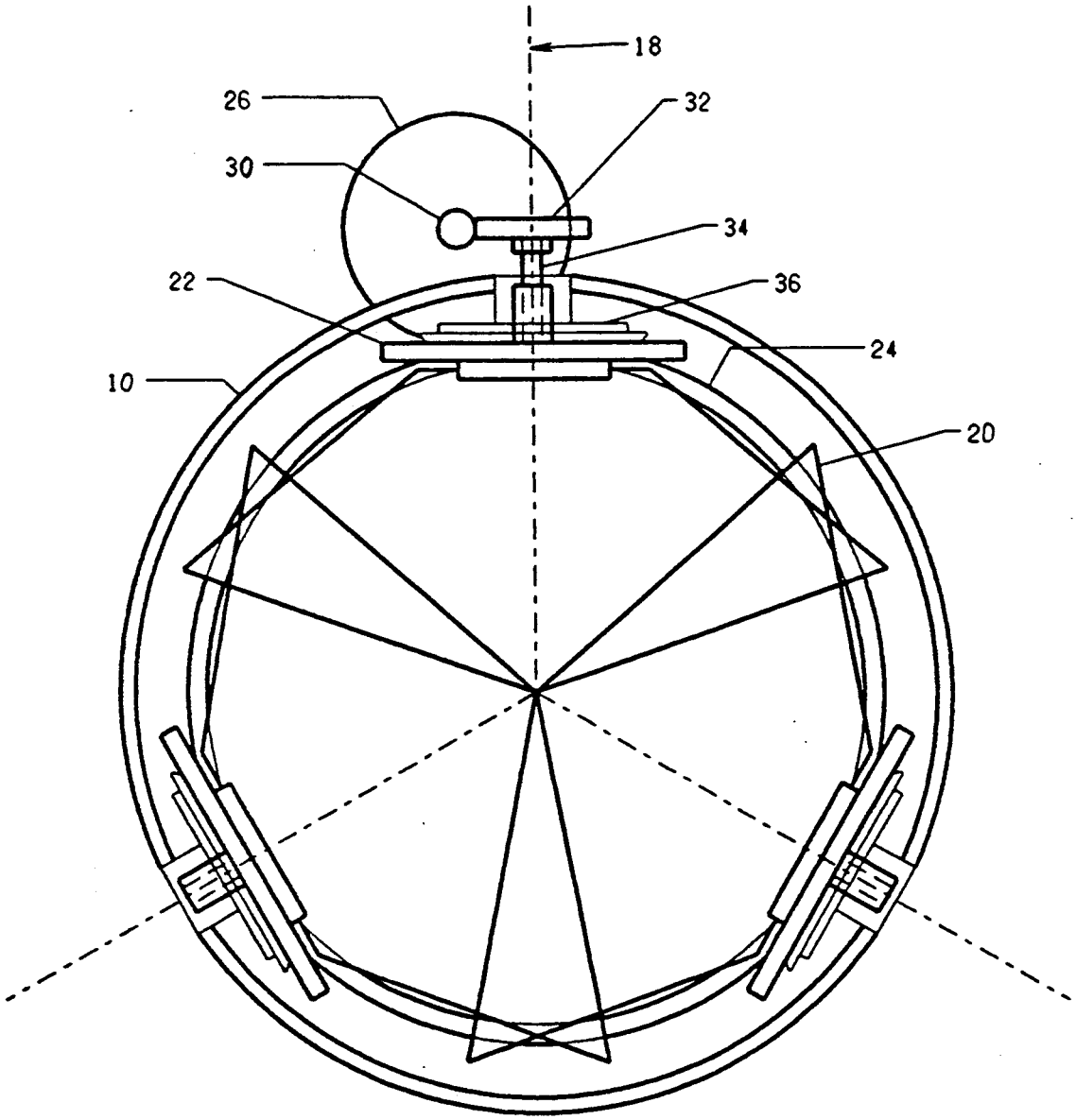
FIG. 3 is a schematic end view of the embodiment of FIG. 2.

Referring now to FIG. 3, a preferred drive mechanism for pivoting the filters 20 will be described. Each set of three filters is pivoted under the control of a bi-directional stepper motor 26 mounted to the frame 10 in a suitable manner (not shown). The shaft 28 of the motor 26 terminates in a worm gear 30. A worm wheel 32 is mounted on one of the filter supporting wheels 22 by means of a drive shaft 34. Each filter supporting wheel 22 has a geared periphery which engages complementary gear teeth on ring gear 24 as schematically depicted in FIGS. 2 and 3. Because the filter supporting wheels 22 are the same size and each is driven by a ring gear 24 common to each module, all three filters of each module are rotated in synchronization. The motor 26 may be energized by a conventional control system (not shown) comprising motor driver circuits, feedback sensors, and suitable electronic control circuits. Referring again to FIG. 2, it will be appreciated that each filter set A, B and C is independently pivotable under the control of a separate drive motor 26.

Figure 4:
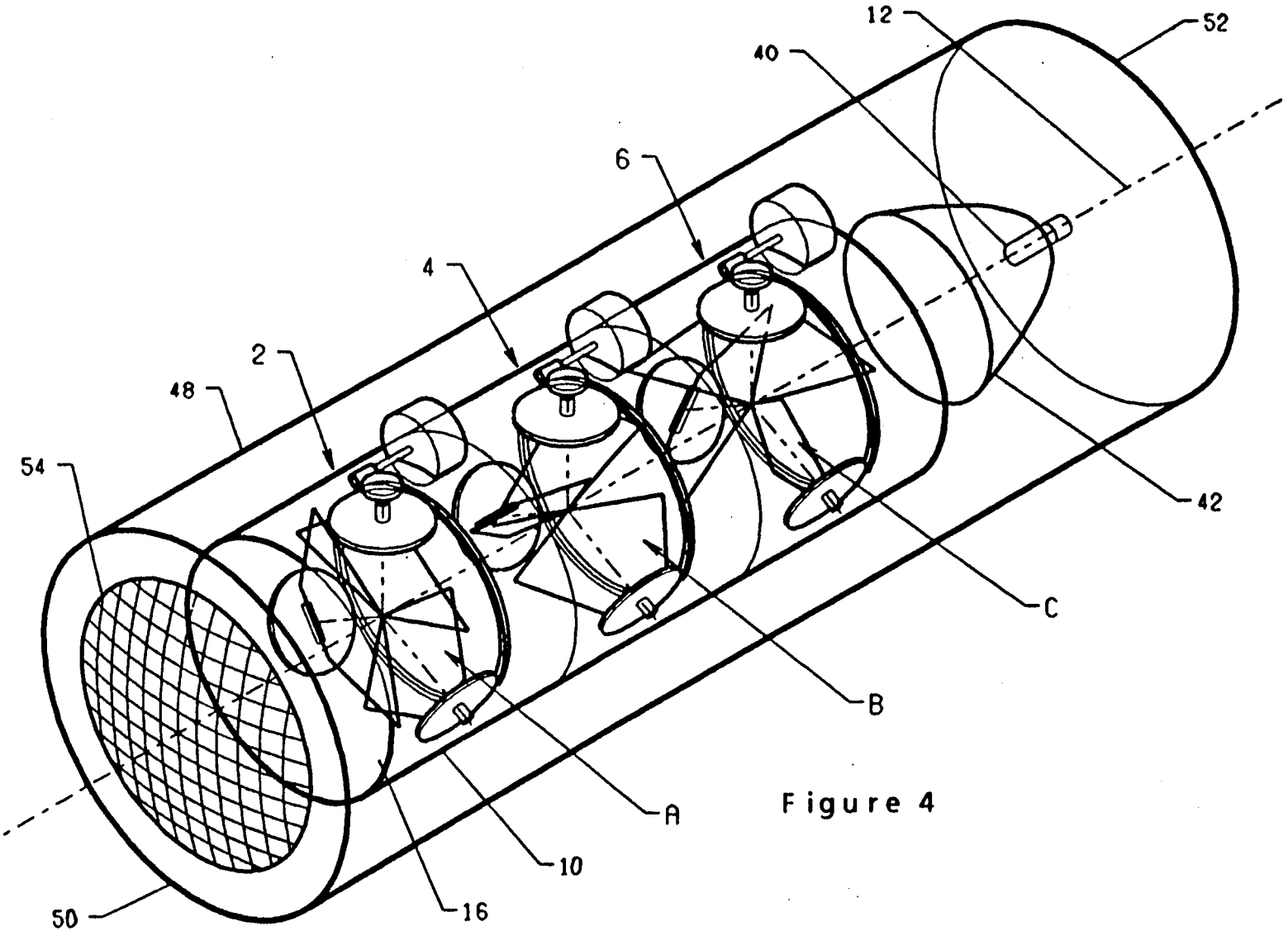
FIG. 4 is a schematic perspective view of a lighting assembly including the three modules of FIG. 2 enclosed within a cylindrical housing in accordance with one embodiment of the present invention.

Referring now to FIG. 4, a lighting instrument including the assembly of FIG. 2 is shown assembled in a cylindrical exterior housing 48. It will be appreciated that housing shapes other than cylindrical may also be employed. The housing 48 provides a means for mounting and protecting the filter modules and other components to be described. Conventional mounting hardware (not shown) is employed. The housing 48 is closed at the front end by bulkhead 50 and at the back end by bulkhead 52.

A lamp 40 and reflector 42 are mounted on the back bulkhead 52. The lamp 40 and reflector 42 serve as a light source to project a beam of light along the longitudinal axis 12. The beam first passes through pivoting filter set C, then passes through pivoting filter set B, and finally passes through pivoting filter set A.

A lenticular front glass 54 is also disposed transverse to axis 12, and intercepts the beam of light after the beam passes through pivoting filter set A. The glass directs the beam to provide a beam shape characteristic of wash luminaires. The glass is mounted in an aperture centered in front bulkhead 50.

The lighting instrument of FIG. 4 may be employed as one of many such instruments in an automated system such as described in the Bornhorst '187 patent. In such a system, means are provided for suspending the lighting instrument, controlling its orientation and controlling such beam parameters as divergence and intensity. The lighting instrument of FIG. 4 depicts a unique arrangement of pivotal filters for controlling beam color and saturation.

To control beam intensity, lamp 40 may be a low-voltage incandescent type, such as a tungsten-halogen lamp, and may be coupled to an electronic dimmer (not shown). Alternately, lamp 40 may be an arc lamp, such as a metal-halide discharge lamp, and may be modulated in brightness or intensity by conventional mechanical dimming means (not shown) mounted within housing 48.

Figure 5A:
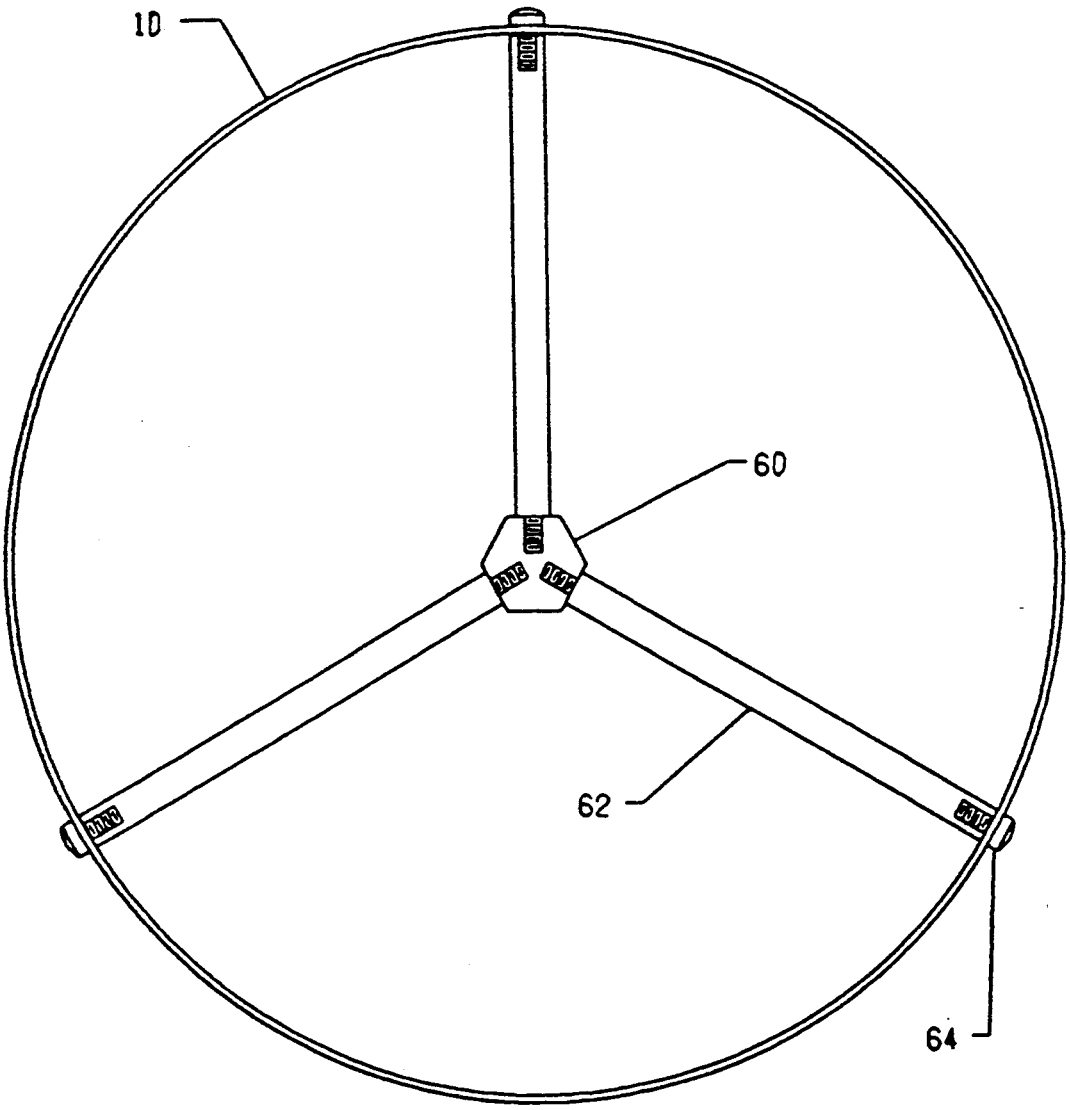
FIG. 5A is a cross-sectional view of a cylindrical frame showing a preferred center support according to the present invention.

A preferred technique for supporting the filters in tubular frame 10 is illustrated in FIG. 5A. A center support member 60, which preferably is a long aluminum bar of hexagonal cross-section, is supported Within frame 10 by radial arms 62. The arms 62 have threaded ends secured in the member 60. Threaded fasteners 64 secure the arms 62 to the frame 10.

Figure 5B:
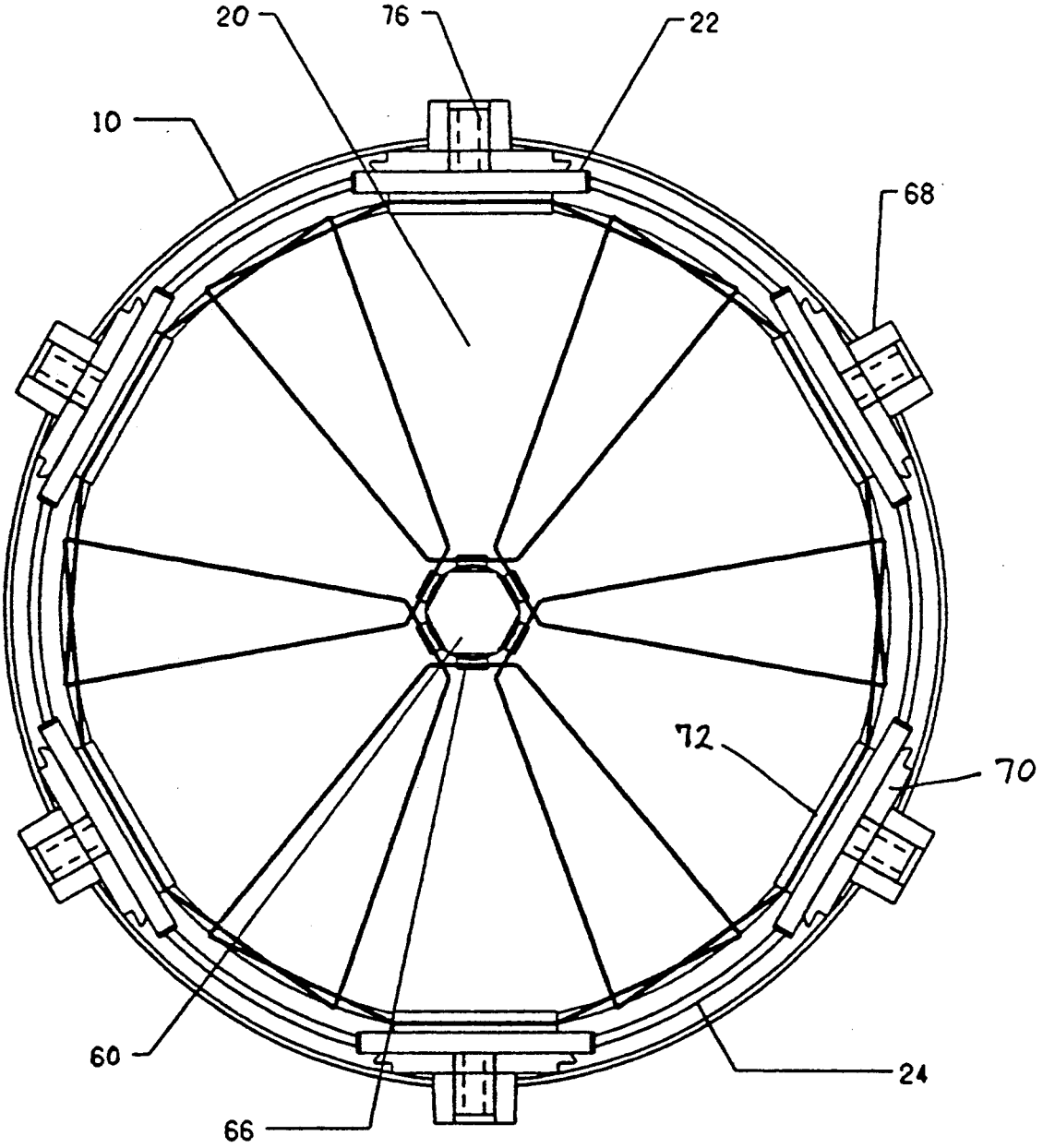
FIG. 5B is a radial cross-sectional view of a cylindrical frame showing one module of six pivotable filters used in a stage light according to another embodiment of the present invention.
Figure 5C:
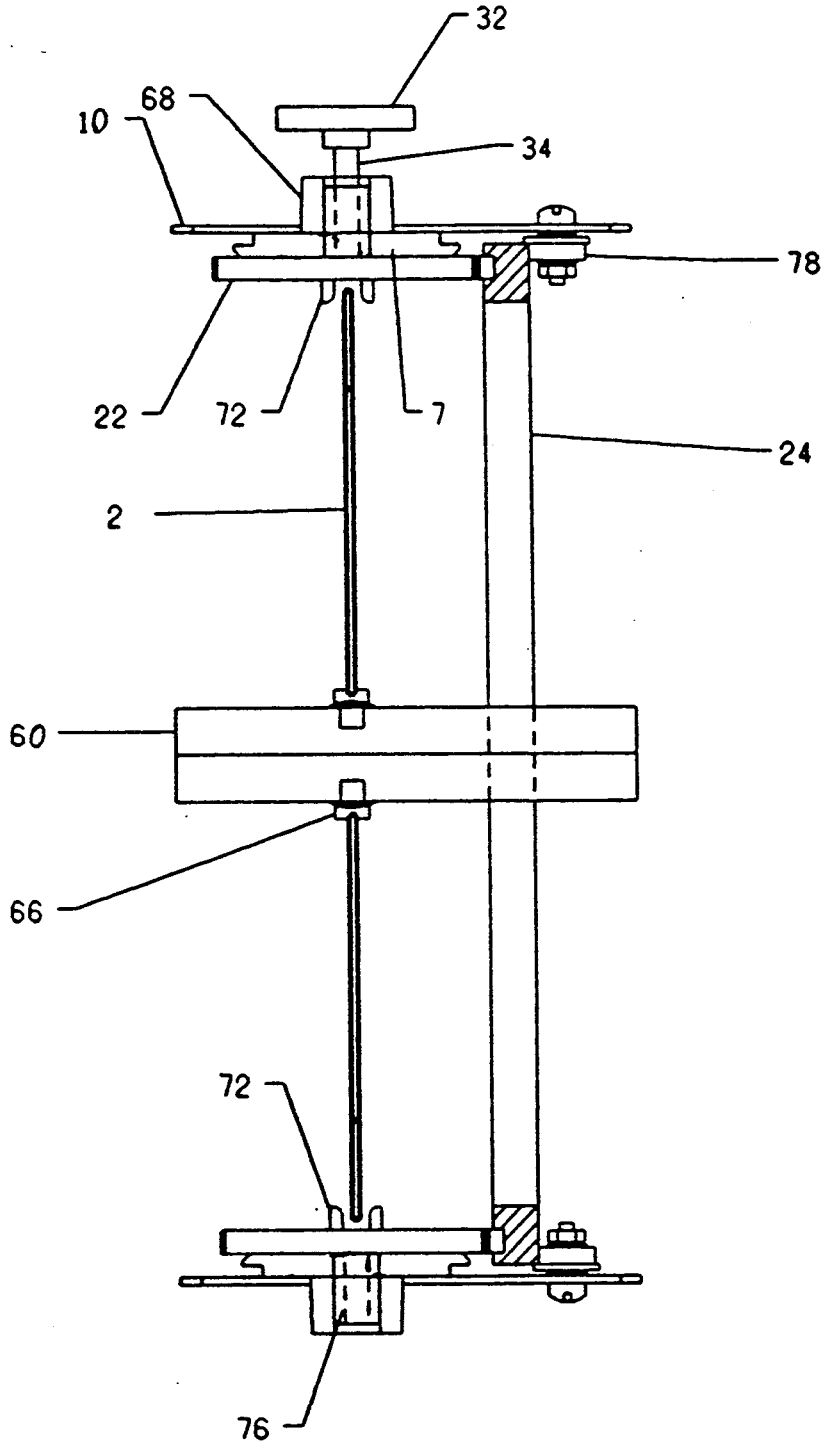
FIG. 5C is an axial cross-sectional view of the embodiment of FIG. 5B.

Referring now to FIGS. 5B and 5C, an alternate arrangement of six dichroic filters is shown arranged radially about center support member 60. Each filter is fastened at its inner end to support member 60 by a U-shaped clip 66. Each clip 66 is rotatable with respect to the support member 60. Each filter 20 is supported at its outer end by a gear wheel 22 which has a U-shaped channel 72 on its inner face for receiving the filter. Each gear wheel 22 is rotatably supported just inside the frame 10 by a bushing 68 secured in the frame wall. A low friction spacer or bearing 70 separates the gear wheel 22 from the bushing 68.

Each gear wheel 22 has a hollow shaft 76 extending through the bearing 70 into the bushing 68. The material of the bushing 68 is chosen to present a minimum of friction between the bushing and the shaft 76 of the rotating gear wheel 22.

The gear wheels 22 are coupled for synchronous rotation by a ring gear 24, seen best in FIG. 5C. The ring gear 24 is maintained in engagement with the gear wheels by bearings 78 secured to the frame by suitable fastening means. To accomplish the rotation, one filter supporting wheel 22 is fitted with a drive shaft 34 which is inserted into the hollow shaft 76 of the selected wheel 22 and secured therein by a suitable adhesive. A worm wheel 32 is attached to drive shaft 34 to provide for motorized operation of the pivoting-filter assembly as described above with reference to FIG. 2.

Figure 5D:
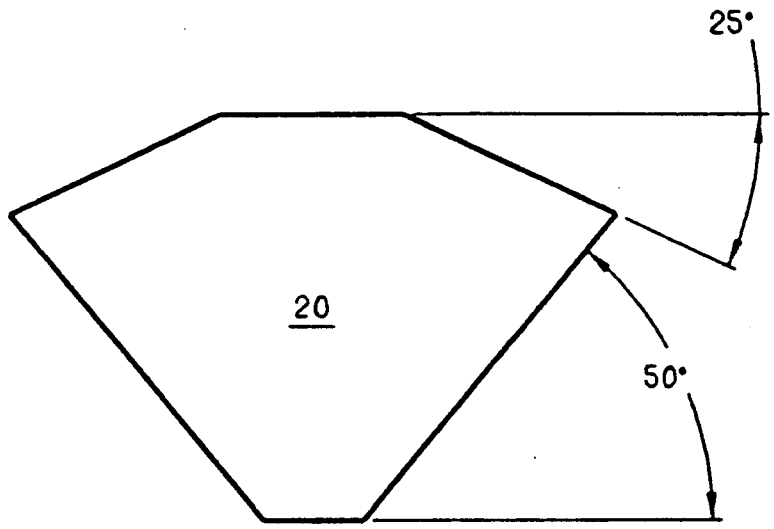
FIG. 5D is a plan view of one pivotable filter used in the embodiment of FIG. 5B.

The preferred shape of the filters employed in the embodiment of FIG. 5B is illustrated in FIG. 5D. The filter 20 is a six-sided irregular polygon having two parallel sides for mounting as described above. The shape of the filter is selected so that the arrangement of six such filters depicted in FIG. 5B will intercept substantially all of the light rays of the light beam in the intermediate positions between the fully closed position and the 45 degree position (i.e., half way between the fully closed and fully open positions).

It will be appreciated that embodiments of the invention can be constructed with any number of filters. The six-filter per set embodiment of FIG. 5B is believed to provide an optimum stage-lighting instrument. The three-filter per set embodiment of FIG. 4 is more suitable for smaller track lighting instruments for use in offices and is easier to illustrate in perspective view than the embodiment of FIG. 5B. One skilled in the art will readily appreciate the resulting structure achieved by substituting three modules of the six-filter embodiment of FIG. 5B for the modules 2, 4 and 6 of FIG. 4.

The present invention also contemplates applications other than for stage lighting. For example, a large lighting apparatus such as a search light for illuminating the night sky with different colored beams can be constructed using the foregoing techniques. In such an embodiment of the invention, a much larger number of pivoting filters is contemplated so as to minimize the axial dimension of the filter assembly. It will be appreciated that the disclosed radial arrangement of filters is ideally suited to the projection of a circular light beam and provides economic and performance advantages over square or rectangular filter arrangements.

It will be understood that the present invention is not limited to the embodiments disclosed, but is capable of rearrangements, modifications, substitution of equivalent parts and elements without departing from the spirit of the invention as defined in the following claims.

What is claimed is:

1. A lighting instrument comprising:

a light source for projecting a beam of light along a primary axis of the instrument;

at least a first set of filters rotatably supported within the instrument, each filter being characterized in that light passing through the filter varies in color depending upon the angular orientation of the filter with respect to the light beam; and a drive mechanism for each set of filters carried by the instrument and connected to the respective filters for rotating each filter about an axis, the axis of rotation of each filter intersecting the primary axis and the axis of rotation of at least one other filter at a common point, each filter being rotatable through a range of positions from an open position in which the filter is disposed substantially parallel to the primary axis to a closed position, whereby the set of filters in the closed position intercepts substantially the entire light beam passing through the instrument.

2. The lighting instrument of claim 1 wherein the axes of rotation of the filters of each set are angularly spaced symmetrically about the primary axis.

3. The lighting instrument of claim 2 wherein the filters of each set overlap each other partially in the closed position and remain partially overlapped in positions between the closed position and a position rotated approximately half the angular range from the closed position to the open position.

4. The lighting instrument of claim 1 further comprising a second set of filters similar to the first set of filters and spaced apart from the first set along the primary axis, the filters of the second set having optical transmission characteristics different from the filters of the first set.

5. The lighting instrument of claim 4 further comprising a third set of filters similar to the first and second sets of filters and spaced from the first and second sets along the primary axis, the filters of the third set having optical transmission characteristics different from the filters of the first and second sets, the first set comprising long-wave pass filters, the second set comprising short-wave pass filters and the third set comprising complex-color filters.

6. The lighting instrument of claim 4 wherein the axes of rotation of the filters of each set define a radial plane.

7. A lighting instrument comprising:

a frame having a longitudinal axis;

a light source disposed at one end of the frame for projecting a beam of light through the frame in the direction of the longitudinal axis;

at least one set of color filters supported by the frame for varying the color of light passing through the filters, each filter further being pivotable about an axis of rotation intersecting the longitudinal axis and the axis of rotation of at least one other filter; and means for rotating the filters in synchronization between a closed position in which substantially all of the light beam passes through the filters to an open position in which essentially none of the light beam passes through the filters.

8. The lighting instrument of claim 7 wherein each filter has an inner end rotatably secured near the primary axis and an outer end spaced therefrom and wherein each filter is shaped to intercept less than half of the light beam when in its closed position.

9. The lighting instrument of claim 8 further comprising:

a second set of dichroic filters supported by the frame and exhibiting optical transmission characteristics substantially identical to each other but different from the filters of the first set, each filter of the second set being pivotable about an axis intersecting the longitudinal axis, the second set being longitudinally spaced from the first set; and second means for rotating the filters of the second set in synchronization with each other and independently from the filters of the first set, the second means pivoting the filters of the second set between a closed position in which substantially all of the light beam passes through the respective filters to an open position in which essentially none of the light beam passes through the respective filters.

10. The lighting instrument of claim 9 wherein the filters of the first set consist of long-wave pass filters and the filters of the second set consist of short-wave pass filters.

11. The lighting instrument of claim 8 wherein the axes of pivotal movement of the filters define a radial plane.

12. The lighting instrument of claim 11 wherein the rotating means comprises:

a gear wheel engaging the outer end of each filter;

a ring gear engaging each gear wheel; and means for rotating one gear wheel to cause each filter to pivot about its axis of rotation.

13. A lighting instrument for altering the color of a beam of light projected along a primary axis of the instrument, comprising:

first and second sets of pivotable color filters for varying the color of light passing through the filters, each color filter being pivotable about an axis of rotation intersecting the primary axis and the axis of rotation of at least one other filter, said sets being spaced apart from each other along the primary axis; and means associated with each set of filters for pivoting the filters in synchronization with each other and independently relative to those of the other set to enable selection of different colored light beams by selective positioning of the filters.

14. The lighting instrument of claim 13 wherein the axes of pivotal movement of the filters of each set define a radial plane.

15. The lighting instrument of claim 14 wherein the filters of the first set consist of long-wave pass amber filters and the filters of the second set consist of short-wave pass blue filters.

16. The lighting instrument of claim 15 further comprising:

a third set of pivotable dichroic filters disposed in optical series relationship with the first and second sets; and means for independently pivoting the filters of the third set, the filters of the third set being complex-color magenta filters.

17. A lighting instrument comprising:

a frame having a longitudinal axis;

first and second longitudinally spaced sets of color filters supported by the frame for varying the color of light passing through the filters, the filters of each set being pivotable about axes intersecting the longitudinal axis;

first and second annular actuating members supported by the frame and rotatable about the longitudinal axis;

a first set of pivoting actuators coupling filters of the first set to the first annular actuating member;

a second set of pivoting actuators coupling filters of the second set to the second annular actuating member;

first drive means for driving the first annular actuating member for pivoting the first set of filters; and second drive means for driving the second annular actuating member for pivoting the second set of filters independently from the pivoting action of the first set of filters.

18. The lighting instrument of claim 17 wherein the axes of pivotal movement of the filters of each set define a radial plane.

19. A lighting instrument comprising;

a frame having a longitudinal axis;

a light source disposed at one end of the frame for projecting a beam of light through the frame in the direction of the longitudinal axis;

at least one set of color filters for varying the color of light passing through the filters, said filters being disposed generally radially about said longitudinal axis; and a drive mechanism coupled to each filter for rotating each filter about an axis of rotation generally transverse to said longitudinal axis.

20. A lighting instrument as in claim 19 further including a plurality of sets of said color filters, said sets being spaced apart from each other along the longitudinal axis of said beam.

* * * * *